US011347164B2

(12) United States Patent
Suenami

(10) Patent No.: US 11,347,164 B2
(45) Date of Patent: May 31, 2022

(54) DEVELOPING DEVICE WHICH SUPPLIES TWO-COMPONENT DEVELOPER CONTAINING TONER AND CARRIER AND WHICH DISCHARGES EXCESSIVE DEVELOPER AND IMAGE FORMING APPARATUS THEREWITH

(71) Applicant: KYOCERA Document Solutions Inc., Osaka (JP)

(72) Inventor: Koji Suenami, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/368,027

(22) Filed: Jul. 6, 2021

(65) Prior Publication Data

US 2022/0011693 A1 Jan. 13, 2022

(30) Foreign Application Priority Data

Jul. 10, 2020 (JP) ..... JP2020-119325

(51) Int. Cl.
*G03G 15/08* (2006.01)

(52) U.S. Cl.
CPC ..... *G03G 15/0891* (2013.01); *G03G 15/0844* (2013.01); *G03G 15/0893* (2013.01);
(Continued)

(58) Field of Classification Search
CPC ..... G03G 15/0891; G03G 15/0893; G03G 2215/0822; G03G 2215/0819;
(Continued)

(56) References Cited

U.S. PATENT DOCUMENTS

2009/0257783 A1* 10/2009 Hatakeyama ..... G03G 15/0822 399/256
2011/0236074 A1* 9/2011 Maeda ..... G03G 15/0893 399/254

(Continued)

FOREIGN PATENT DOCUMENTS

JP 2009251555 A * 10/2009 ..... G03G 15/0822
JP 2015-11158 A 1/2015

*Primary Examiner* — Walter L Lindsay, Jr.
*Assistant Examiner* — Laura Roth
(74) *Attorney, Agent, or Firm* — Stein IP, LLC

(57) ABSTRACT

A developing device includes a developer container, a developer carrier, and first and second members for stirring/conveying. The developing container has a first partition wall between first and second chambers, communication portions through which those chambers communicate at opposite ends of the first partition wall, a developer supply port, and a developer discharge portion. The first member stirs and conveys developer in the first chamber in a first direction. The second member stirs and conveys developer in the second chamber in a second direction and includes a regulating portion and a discharging blade. The developer container includes a second partition wall between the first chamber and the regulating portion. The second partition wall is lower than the first partition wall, and an upper end part of the second partition wall is between upper and lower end parts of the rotary shaft of the second stirring/conveying member.

6 Claims, 6 Drawing Sheets

(52) U.S. Cl.
CPC ..... *G03G 2215/083* (2013.01); *G03G 2215/0822* (2013.01); *G03G 2215/0838* (2013.01)

(58) Field of Classification Search
CPC ..... G03G 2215/0827; G03G 2215/083; G03G 2215/0838; G03G 15/0877; G03G 15/0844
See application file for complete search history.

(56) References Cited

U.S. PATENT DOCUMENTS

| | | | | |
|---|---|---|---|---|
| 2015/0003876 | A1 | 1/2015 | Iida et al. | 399/254 |
| 2017/0060031 | A1* | 3/2017 | Iida | G03G 15/0893 |
| 2017/0176890 | A1* | 6/2017 | Sasaki | G03G 15/0891 |
| 2021/0364944 | A1* | 11/2021 | Fujishima | G03G 15/0812 |
| 2021/0364951 | A1* | 11/2021 | Sasaki | G03G 15/0889 |

* cited by examiner

DEVELOPING DEVICE WHICH SUPPLIES TWO-COMPONENT DEVELOPER CONTAINING TONER AND CARRIER AND WHICH DISCHARGES EXCESSIVE DEVELOPER AND IMAGE FORMING APPARATUS THEREWITH

INCORPORATION BY REFERENCE

This application is based on and claims the benefit of Japanese Patent Application No. 2020-119325 filed on Jul. 10, 2020, the contents of which are hereby incorporated by reference.

BACKGROUND

The present disclosure relates to developing devices used in image forming apparatuses employing electrophotography, such as copiers, printers, facsimile machines, and multifunction peripherals incorporating their functions, and to image forming apparatuses provided with such a developing device. More particularly, the present disclosure relates to developing devices which supply two-component developer containing toner and carrier and which discharge excessive developer, and to image forming apparatuses provided with such a developing device.

In image forming apparatuses, a latent image formed on an image carrying member composed of a photosensitive member or the like is developed by a developing device to be visualized as a toner image. In one type of such developing devices, a two-component development system that uses two-component developer is adopted. This type of developing device stores two-component developer containing carrier and toner in a developer container, and includes a developing roller (developer carrying member) which supplies the developer to the image carrying member and a stirring/conveying member which supplies, while conveying and stirring, the developer in the developer container to the developing roller.

In a developing device employing the two-component development system, while toner is consumed as development operation proceeds, carrier remains in the developing device unconsumed. Thus stirred together with toner in the developer container, carrier degrades as it is stirred repeatedly. As a result, the electrostatic charging performance of carrier with respect to toner gradually degrades.

To cope with that, there has been proposed a developing device that employs a CASS (carrier auto streaming system) to supply developer containing carrier to the developer container and that discharges excessive developer, thereby preventing degradation in electrostatic charging performance.

Incidentally, the height of developer tends to decrease in a high humidity environment and to increase in a low humidity environment. This causes the weight of developer in the developer container to vary depending on the environment in which the image forming apparatus is used. There is thus concern for, when the environment changes from a high humidity one to a low humidity one, a sudden increase in the amount of developer discharged and, when the environment changes from a low humidity one to a high humidity one, development failure due to an insufficient height of developer.

For example, in a known developing device, a disk portion is provided in a path for discharging developer in the developing device toward a discharge port, and an end part of a reversing screw provided upstream of the disk portion in the discharging direction is arranged so as not to be joined to the disk portion. In this developing device, developer is restrained from being lifted up due to the disk portion being joined to a conveying portion upstream of the disk portion, and this helps stabilize the amount of developer discharged.

SUMMARY

According to one aspect of the present disclosure, a developing device includes a developing container, a developer carrying member, a first stirring/conveying member, and a second stirring/conveying member. The developer container has first and second conveying chambers which are arranged side by side, a first partition wall which partitions between the first and second conveying chambers along the longitudinal direction, communication portions through which the first and second conveying chambers communicate with each other in opposite end parts of the first partition wall, a developer supply port through which developer containing magnetic carrier and toner is supplied, and a developer discharge portion which is provided in a downstream-side end part of the second conveying chamber and through which excessive developer is discharged. The developer carrying member is rotatably supported on the developer container and carries, on the surface of the developer carrying member, the developer in the second conveying chamber. The first stirring/conveying member includes a rotary shaft and a first conveying blade formed on the outer circumferential face of the rotary shaft, and stirs and conveys the developer in the first conveying chamber in a first direction. The second stirring/conveying member includes a rotary shaft and a second conveying blade formed on the outer circumferential face of the rotary shaft, and stirs and conveys the developer in the second conveying chamber in a second direction opposite to the first direction. The second stirring/conveying member includes a regulating portion and a discharging blade. The regulating portion is formed adjacent to the second conveying blade on its downstream side in the second direction, and is composed of a conveying blade for conveying the developer in the direction opposite to the second conveying blade. The discharging blade is formed adjacent to the regulating portion on its downstream side in the second direction, and conveys the developer in the same direction as the second conveying blade to discharge the developer through the developer discharge portion. The communication portions are composed of a first communication portion through which, at the downstream side in the first direction, the developer is passed from the first conveying chamber to the second conveying chamber and a second communication portion through which, at the downstream side in the second direction, the developer is passed from the second conveying chamber to the first conveying chamber. The developer container includes a second partition wall which is arranged adjacent to the regulating portion on the downstream side of the second communication portion in the second direction to partition between the first conveying chamber and the regulating portion. The second partition wall has a smaller height than the first partition wall, and an upper end part of the second partition wall is located between an upper end part and a lower end part of the rotary shaft of the second stirring/conveying member.

DETAILED DESCRIPTION

Figure 1:
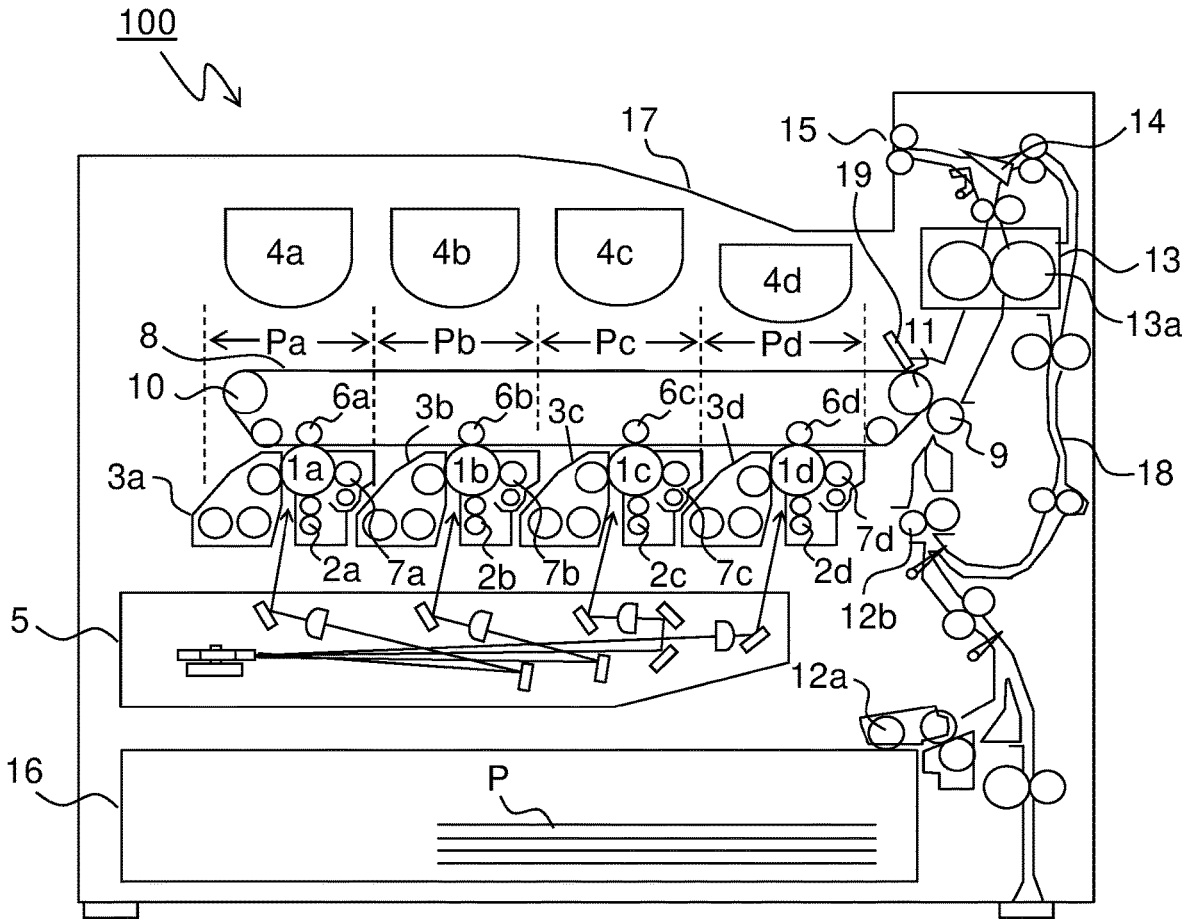
FIG. 1 is a schematic sectional view of an image forming apparatus mounted with a developing device according to the present disclosure.

Hereinafter, with reference to the accompanying drawings, embodiments of the present disclosure will be described. FIG. 1 is a sectional view showing an internal structure of an image forming apparatus 100 mounted with developing devices 3*a* to 3*d* according to the present disclosure. In the image forming apparatus 100 (here, a color printer), four image forming portions Pa, Pb, Pc and Pd are arranged in this order from upstream (the left side in FIG. 1) in the conveying direction. These image forming portions Pa to Pd are provided so as to correspond to images of four different colors (cyan, magenta, yellow, and black) and sequentially form images of cyan, magenta, yellow, and black through the processes of electrostatic charging, exposure to light, image development, and image transfer.

In these image forming portions Pa to Pd, photosensitive drums (image carrying members) 1*a*, 1*b*, 1*c*, and 1*d* are respectively arranged which carry visible images (toner images) of the different colors. Further, an intermediate transfer belt 8 which rotates, by the action of a driving mean (unillustrated), counter-clockwise in FIG. 1 is provided adjacent to the image forming portions Pa to Pd. The toner images formed on the photosensitive drums 1*a* to 1*d* are primarily transferred sequentially, while being superimposed on each other, to the intermediate transfer belt 8 that moves while keeping contact with the photosensitive drums 1*a* to 1*d*. Then, the toner images primarily transferred to the intermediate transfer belt 8 are secondarily transferred by a secondary transfer roller 9 to transfer paper P, which is one example of a recording medium. The transfer paper P to which the toner images have been secondarily transferred is, after having the toner images fixed to it in a fixing portion 13, discharged out of the main body of the image forming apparatus 100. An image forming process is performed with respect to the photosensitive drums 1*a* to 1*d* while they are rotated clockwise in FIG. 1.

The transfer paper P to which the toner images are to be secondarily transferred is stored in a sheet feeding cassette 16 arranged in a lower part of the main body of the image forming apparatus 100, and is conveyed via a sheet feeding roller 12*a* and a registration roller pair 12*b* to a nip portion between the secondary transfer roller 9 and a driving roller 11 for the intermediate transfer belt 8. Used as the intermediate transfer belt 8 is a sheet of dielectric resin, and typically is a belt without seams (seamless belt). On the downstream side of the secondary transfer roller 9, a blade-form belt cleaner 19 is arranged for removing toner and the like left on the surface of the intermediate transfer belt 8.

Next, the image forming portions Pa to Pd will be described. Around and below the photosensitive drums 1*a* to 1*d* that are rotatably arranged, there are provided charging devices 2*a*, 2*b*, 2*c*, and 2*d* which electrostatically charge the photosensitive drums 1*a* to 1*d* respectively, an exposure device 5 which exposes the photosensitive drums 1*a* to 1*d* to light carrying image information, developing devices 3*a*, 3*b*, 3*c*, and 3*d* which form toner images on the photosensitive drums 1*a* to 1*d* respectively, and cleaning devices 7*a*, 7*b*, 7*c*, and 7*d* which remove developer (toner) and the like left on the photosensitive drums 1*a* to 1*d* respectively.

When image data is input from a host device such as a personal computer, first, the surfaces of the photosensitive drums 1*a* to 1*d* are electrostatically charged uniformly by the charging devices 2*a* to 2*d*. Next, the exposure device 5 irradiates the photosensitive drums 1*a* to 1*d* with light based on the image data to form on them electrostatic latent images reflecting the image data. The developing devices 3*a* to 3*d* are loaded with predetermined amounts of two-component developer containing cyan, magenta, yellow, and black toner respectively. When, through formation of toner images, which will be described later, the proportion of toner in the two-component developer stored in the developing devices 3*a* to 3*d* falls below a prescribed value, developer containing toner and carrier is supplied from containers 4*a* to 4*d* to the developing devices 3*a* to 3*d* respectively. The toner in the developer is fed from the developing devices 3*a* to 3*d* to the photosensitive drums 1*a* to 1*d*, and electrostatically attaches to them to form toner images based on the electrostatic latent images formed through exposure to light from the exposure device 5.

Then, by primary transfer rollers 6*a* to 6*d*, electric fields with a predetermined transfer voltage are applied between the primary transfer rollers 6*a* to 6*d* and the photosensitive drums 1*a* to 1*d*, and the cyan, magenta, yellow, and black toner images on the photosensitive drums 1*a* to 1*d* are primarily transferred to the intermediate transfer belt 8. These images in four colors are formed with a predetermined positional relationship with each other that is prescribed for formation of a predetermined full-color image. Then, in preparation for the subsequent formation of new electrostatic latent images, toner and the like left on the surface of the photosensitive drums 1*a* to 1*d* after the primary transfer are removed by the cleaning devices 7*a* to 7*d*.

The intermediate transfer belt 8 is stretched around a driven roller 10 on the upstream side and the driving roller 11 on the downstream side. As the driving roller 11 is driven to rotate by a belt driving motor (unillustrated), the intermediate transfer belt 8 starts to rotate counter-clockwise, and the transfer paper P is conveyed with predetermined timing from the registration roller pair 12*b* to a nip portion (secondary transfer nip portion) between the driving roller 11 and the secondary transfer roller 9 arranged adjacent to it. The full-color image on the intermediate transfer belt 8 is thus secondarily transferred to the transfer paper P. The transfer paper P on which the toner images have been secondarily transferred is conveyed to the fixing portion 13.

The transfer paper P conveyed to the fixing portion 13 is heated and pressed by a fixing roller pair 13*a*, and thereby the toner images are fixed on the surface of the transfer paper P to form the predetermined full-color image. The transfer paper P on which the full-color image has been formed has its conveying direction switched by a branch portion 14 which is branched into a plurality of directions, and is then directly (or after being fed to a duplex printing conveying passage 18 to have images formed on both its faces) discharged to a discharge tray 17 by a discharge roller pair 15.

Figure 2:
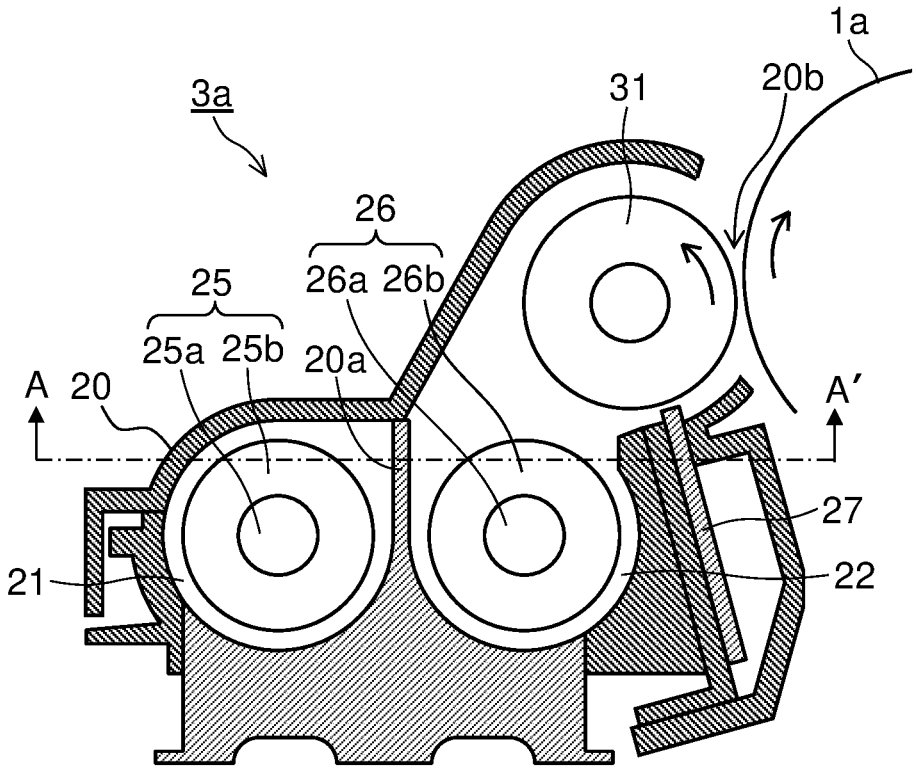
FIG. 2 is a side sectional view of a developing device according to a first embodiment of the present disclosure.

FIG. 2 is a side sectional view of a developing device 3*a* according to a first embodiment of the present disclosure incorporated in the image forming apparatus 100. The following description deals with, as an example, the developing device 3*a* arranged in the image forming portion Pa in FIG. 1. The developing devices 3*b* to 3*d* arranged in the image forming portions Pb to Pd have a structure basically similar to that of the developing device 3*a*, and thus no overlapping description will be repeated.

As shown in FIG. 2, the developing device 3*a* includes a developer container 20 that stores two-component developer (hereinafter also referred to simply as developer) containing magnetic carrier and toner. The developer container 20 is partitioned into a stirring/conveying chamber 21 and a feeding/conveying chamber 22 by a first partition wall 20*a*. In the stirring/conveying chamber 21 and the feeding/conveying chamber 22, there are respectively rotatably arranged a stirring/conveying screw 25 and a feeding/conveying screw 26 which mix the toner and the carrier fed from the container 4*a* (see FIG. 1) with the developer in the developer container 20 and which stir the mixture and thereby electrostatically charge the toner.

The stirring/conveying screw 25 arranged in the stirring/conveying chamber 21 includes a rotary shaft 25*a* and a first conveying blade 25*b* which is provided integrally with the rotary shaft 25*a* and which is formed in a helical shape with a predetermined pitch in the axial direction of the rotary shaft 25*a*. The rotary shaft 25*a* is rotatably pivoted on the developer container 20. The stirring/conveying screw 25 rotates to convey, while stirring, the developer inside the stirring/conveying chamber 21 in a predetermined direction (to one side of the developing roller 31 in its axial direction).

The feeding/conveying screw 26 arranged in the feeding/conveying chamber 22 includes a rotary shaft 26*a* and a second conveying blade 26*b* which is provided integrally with the rotary shaft 26*a* and which is formed in a helical shape with a blade pointing in the same direction (wound in the same direction) as the first conveying blade 25*b*. The rotary shaft 26*a* is arranged parallel to the rotary shaft 25*a* of the stirring/conveying screw 25, and is rotatably supported on the developer container 20. The feeding/conveying screw 26 rotates to convey, while stirring, the developer inside the feeding/conveying chamber 22 in the direction opposite to the stirring/conveying screw 25 to supply the developer to the developing roller 31.

The developer is, while being stirred by the stirring/conveying screw 25 and the feeding/conveying screw 26, conveyed in the axial direction (the direction perpendicular to the plane of FIG. 2) and, via an upstream-side communication portion 20*e* and a downstream-side communication portion 20*f* (for either, see FIG. 3) formed in opposite end parts of the first partition wall 20*a*, circulates between the stirring/conveying chamber 21 and the feeding/conveying chamber 22. Thus, the stirring/conveying chamber 21, the feeding/conveying chamber 22, the upstream-side communication portion 20*e*, and the downstream-side communication portion 20*f* form a circulation passage for the developer inside the developer container 20.

The developer container 20 extends obliquely to the upper right in FIG. 2. To the upper right of the feeding/conveying screw 26 in the developer container 20, a developing roller 31 is arranged. Part of the outer circumferential face of the developing roller 31 is exposed through an opening 20*b* in the developer container 20 so as to face the photosensitive drum 1*a*. The developing roller 31 rotates counter-clockwise in FIG. 2. To the developing roller 31, a developing voltage is applied which is produced by superimposing an alternating-current voltage on a direct-current voltage.

The developing roller 31 is composed of a cylindrical developing sleeve which rotates counter-clockwise in FIG. 2 and a magnet (unillustrated) which is fixed inside the developing sleeve and which has a plurality of magnetic poles. Although a developing sleeve with a knurled surface is used here, any other developing sleeves can instead be used such as one with a number of recesses (dimples) formed on the surface or one with a blasted surface.

To the developer container 20, a regulating blade 27 is fixed along the longitudinal direction of the developing roller 31 (in the direction perpendicular to the plane of FIG. 2). A small clearance (gap) is formed between a tip end part of the regulating blade 27 and the surface of the developing roller 31.

Figure 3:
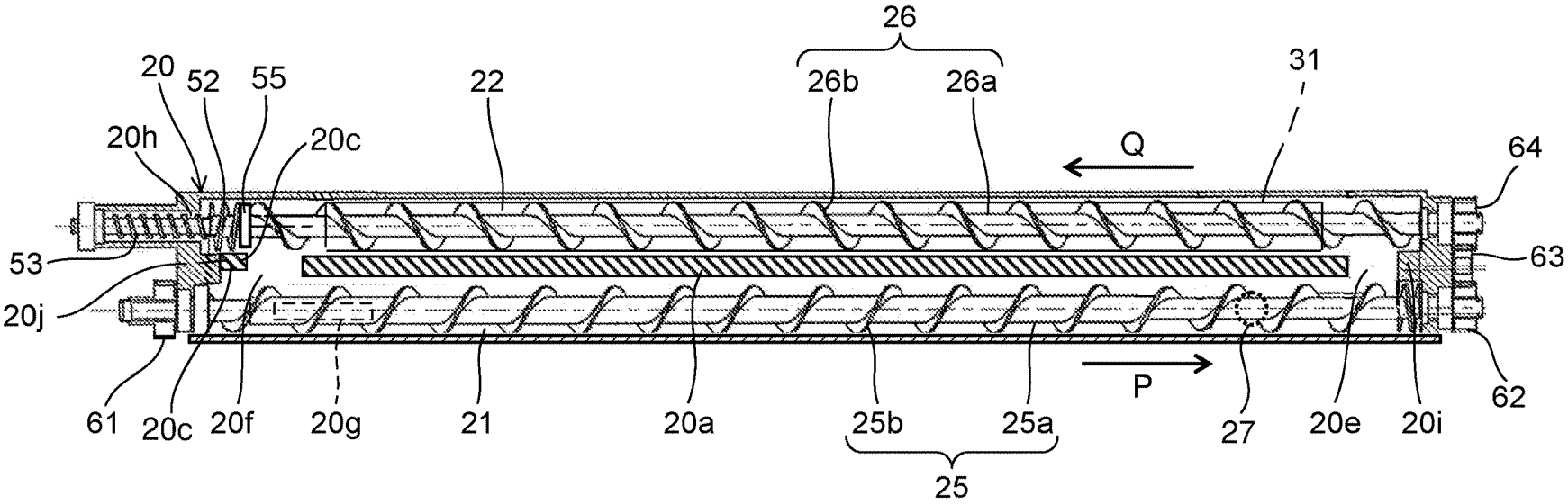
FIG. 3 is a sectional plan view showing a stirring portion in the developing device of the first embodiment.
Figure 4:
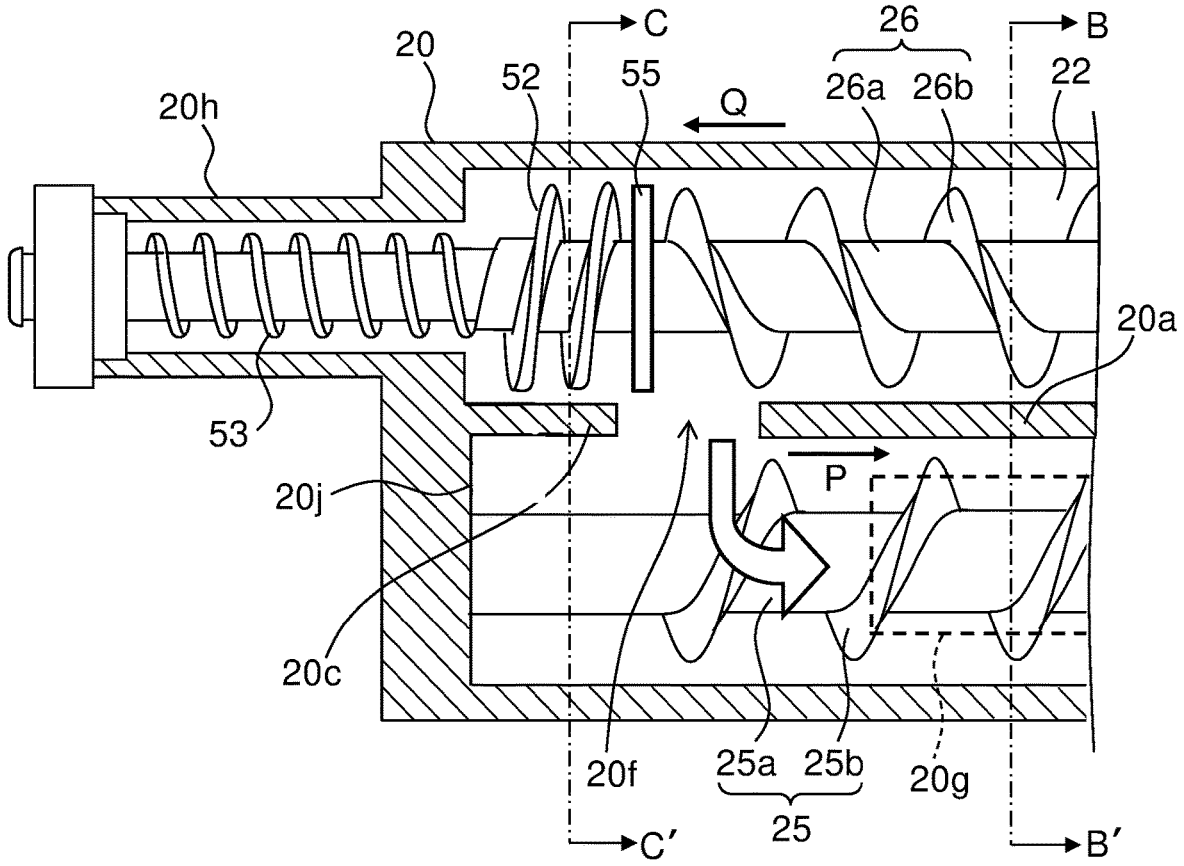
FIG. 4 is an enlarged view of and around a developer discharge portion in FIG. 3.

Next, the structure of a stirring portion in the developing device 3*a* will be described in detail. FIG. 3 is a sectional plan view (as seen from the direction of arrows AA' in FIG. 2) showing a stirring portion in the developing device 3*a* according to the first embodiment. FIG. 4 is an enlarged part view of and around a developer discharge portion 20*h* in FIG. 3.

Formed in the developer container 20 are the stirring/conveying chamber 21, the feeding/conveying chamber 22, the first partition wall 20*a*, a second partition wall 20*c*, the upstream-side communication portion 20*e*, and the downstream-side communication portion 20*f*. Additionally, there are also formed a developer supply port 20*g*, the developer discharge portion 20*h*, an upstream-side wall portion 20*i*, and a downstream-side wall portion 20*j*. It is assumed that, with respect to the stirring/conveying chamber 21, the left side in FIG. 3 is the upstream side and the right side in FIG. 3 is the downstream side, and that, with respect to the feeding/conveying chamber 22, the right side in FIG. 3 is the upstream side, and the left side in FIG. 3 is the downstream side. Accordingly, with respect to the communication portions and the wall portions, the upstream and downstream sides denote those sides with respect to the feeding/conveying chamber 22.

The first partition wall 20*a* extends in the longitudinal direction of the developer container 20 and partitions it into the stirring/conveying chamber 21 and the feeding/conveying chamber 22 such that these are located side by side. The second partition wall 20*c* protrudes from the inner wall surface of the downstream-side wall portion 20*j* and is formed on an extension line from the first partition wall 20*a* so as to face the outer circumferential face of a helical blade constituting a regulating portion 52.

A right-side end part of the first partition wall 20*a* in its longitudinal direction and the inner wall portion of the upstream-side wall portion 20*i* together form the upstream-side communication portion 20*e*. On the other hand, a left-side end part of the first partition wall 20*a* in its longitudinal direction and the second partition wall 20*c* form the downstream-side communication portion 20*f*.

The developer supply port 20*g* is an opening for supplying new toner and carrier to the developer container 20 from the container 4*a* (see FIG. 1) provided in an upper part of the developer container 20, and is arranged on the upstream side (the left side in FIG. 3) of the stirring/conveying chamber 21.

The developer discharge portion 20*h* discharges the developer which has become excessive in the stirring/conveying chamber 21 and the feeding/conveying chamber 22 due to the supply of developer. The developer discharge portion 20*h* is provided on the downstream side of the feeding/conveying chamber 22 continuously in the longitudinal direction of the feeding/conveying chamber 22.

The stirring/conveying screw 25 extends up to the opposite ends of the stirring/conveying chamber 21 in its longitudinal direction and the first conveying blade 25*b* is provided so as to face the upstream-side and downstream-side communication portions 20*e* and 20*f*. The rotary shaft 25*a* is rotatably pivoted on the upstream-side and downstream-side wall portions 20*i* and 20*j* of the developer container 20.

The feeding/conveying screw 26 is longer than the developing roller 31 in its axial direction, and is provided so as to extend up to a position where it faces the upstream-side communication portion 20*e*. The rotary shaft 26*a* is arranged parallel to the rotary shaft 25*a* of the stirring/conveying screw 25, and is rotatably supported on the upstream-side wall portion 20*i* and the developer discharge portion 20*h* of the developer container 20. To the rotary shaft 26*a* of the feeding/conveying screw 26, in addition to the second conveying blade 26*b*, the regulating portion 52 and a discharging blade 53 are integrally molded.

The regulating portion 52 holds back the developer conveyed to the downstream side in the feeding/conveying chamber 22 and conveys the developer exceeding a predetermined amount to the developer discharge portion 20*h*. The regulating portion 52 is composed of a helical blade provided on the rotary shaft 26*a*. This helical blade is a helical blade pointing in the direction opposite to (wound in the direction opposite to) the second conveying blade 26*b*, has substantially the same outer diameter as the second conveying blade 26*b*, and has a pitch smaller than that of the second conveying blade 26*b*. The regulating portion 52 forms a predetermined clearance with the inner wall portion of the developer container 20. Excessive developer moves to the developer discharge portion 20*h* through this clearance.

On the rotary shaft 26*a* in the developer discharge portion 20*h*, the discharging blade 53 is provided. The discharging blade 53 is composed of a helical blade pointing in the same direction as the second conveying blade 26*b* with a smaller pitch and a smaller outer diameter compared to the second conveying blade 26*b*. As the rotary shaft 26*a* rotates, the discharging blade 53 rotates together. The excessive developer which has moved over the regulating portion 52 and has been conveyed into the developer discharge portion 20*h* is conveyed to the left side in FIG. 4 to be discharged to outside the developer container 20 through an unillustrated developer discharge port.

On the outer wall surface of the developer container 20, gears 61 to 64 are arranged. The gears 61 and 62 are fixed to the rotary shaft 25*a*, and the gear 64 is fixed to the rotary shaft 26*a*. The gear 63 is rotatably supported on the developer container 20 and meshes with the gears 62 and 64.

As a developer driving motor (unillustrated) rotates the gear 61, the stirring/conveying screw 25 rotates. The developer in the stirring/conveying chamber 21 is conveyed in the main conveying direction (first direction, arrow P direction) by the first conveying blade 25*b*, and is then conveyed into the feeding/conveying chamber 22 via the upstream-side communication portion 20*e*. As the feeding/conveying screw 26 rotates via the gears 62 to 64, the developer inside the feeding/conveying chamber 22 is conveyed by the second conveying blade 26*b* in the main conveying direction (second direction, arrow Q direction). During development accompanied by no supply of new developer, the developer is, while greatly changing its height, conveyed into the feeding/conveying chamber 22 from the stirring/conveying chamber 21 via the upstream-side communication portion 20*e*. Then, without moving over the regulating portion 52, the developer is conveyed via the downstream-side communication portion 20*f* to the stirring/conveying chamber 21.

In this way, developer is stirred while circulating from the stirring/conveying chamber 21 to the upstream-side communication portion 20*e*, then to the feeding/conveying chamber 22, and then to the downstream-side communication portion 20*f*. The stirred developer is fed to the developing roller 31.

Next, a description will be given of a case where developer is supplied through the developer supply port 20*g*. As toner is consumed in development, developer containing toner and carrier is supplied from the container 4*a* via the developer supply port 20*g* to the stirring/conveying chamber 21.

The supplied developer is, as during development, conveyed inside the stirring/conveying chamber 21 in the main conveying direction (arrow P direction) by the stirring/conveying screw 25, and is then conveyed into the feeding/conveying chamber 22 via the upstream-side communication portion 20*e*. Then, by the feeding/conveying screw 26, the developer inside the feeding/conveying chamber 22 is conveyed in the main conveying direction (arrow Q direction). When the regulating portion 52 rotates as the rotary shaft 26*a* rotates, a conveying force in the direction (the reverse conveying direction) opposite to the main conveying direction is applied to the developer by the regulating portion 52. The developer is held back by the regulating portion 52 to bulk up, and the excessive developer (the same amount as the developer supplied through the developer supply port 20*g*) moves over the regulating portion 52 and is discharged to outside the developer container 20 through the developer discharge portion 20*h*.

As shown in FIG. 4, on the feeding/conveying screw 26, there is arranged a disk 55 between the second conveying blade 26*b* and the regulating portion 52. The disk 55 is, together with the second conveying blade 26*b*, the regulating portion 52, and the discharging blade 53, molded of synthetic resin integrally with the rotary shaft 26*a*.

The developer which is conveyed in the main conveying direction (arrow Q direction) by the second conveying blade 26*b* is held back by the disk 55, and this momentarily weakens the conveying force for the developer. Then, a conveying force in the opposite direction is applied to the developer by the regulating portion 52, and the developer is pushed back in the direction opposite to the main conveying direction. That is, the disk 55 plays a role of reducing the conveying force (pressure) for the developer conveyed from the feeding/conveying chamber 22 to the regulating portion 52. This suppresses waving (fluctuation) at the surface of the developer which is moving to the regulating portion 52 and the downstream-side communication portion 20*f*, and it is thus possible to retain, regardless of the conveying speed of the developer, a nearly constant amount of developer around the regulating portion 52.

Then, when developer is supplied through the developer supply port 20*g* and the height of the developer in the developer container 20 increases, the developer stagnating on the upstream side of the regulating portion 52 moves over the disk 55 and the regulating portion 52 to the discharging blade 53 (developer discharge portion 20*h*), and excessive developer is discharged from the developer discharge portion 20*h*. When the developer ceases to be discharged from the developer discharge portion 20*h*, the height of the developer in the developer container 20 is stabilized. The volume of the developer when its height is stabilized is referred to as the stable volume.

In the image forming apparatus 100 according to the present disclosure, the processing speed can be switched between two speeds depending on the thickness and the kind of the transfer paper P to be conveyed and the type of the output image. That is, when the transfer paper P is regular paper or when a text-based document is output, image forming processing is performed at a regular operation speed (hereinafter, referred to as the full speed mode) and, when the transfer paper P is thick paper or when a photo image is output, image forming processing is performed at a speed (hereinafter, referred to as the slowdown mode) lower than the regular speed. It is thus possible, when thick paper is used as the transfer paper P or when a photo image is output, to secure a sufficient fixing time and improve image quality.

Switching between the full speed mode and the slowdown mode as described above results in a change in the rotation speed of the stirring/conveying screw 25 and the feeding/conveying screw 26, and hence a sharp change in the conveying speed of the developer inside the developer container 20. This results in an uneven distribution of developer inside the developer container 20, and thus a variation in the height (surface level) of the developer. This causes a change also in the amount of developer discharged from the developer discharge portion 20*h*, and hence a change in the amount of developer inside the developer container 20.

Specifically, as the conveying speed of the developer (the rotation speed of the stirring/conveying screw 25 and the feeding/conveying screw 26) increases, even when the weight of the developer inside the developer container 20 is constant, the height of the developer increases. For example, when the conveying speed of the developer is increased, the developer may, before reaching the downstream side of the regulating portion 52, be passed from the feeding/conveying chamber 22 via the downstream-side communication portion 20*f* to the stirring/conveying chamber 21. As a result, less developer reaches the regulating portion 52, and this makes it difficult to discharge developer through the developer discharge portion 20*h*. In this embodiment, the amount of developer discharged is adjusted by adjusting the height of the second partition wall 20*c* that is arranged adjacent to the regulating portion 52.

Figure 5:
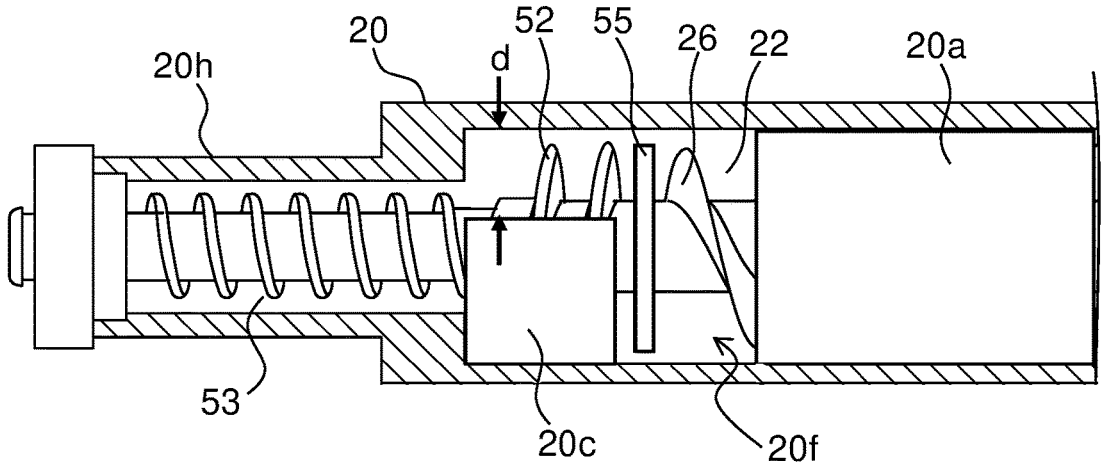
FIG. 5 is a diagram of and around a downstream-side communication portion in FIG. 4, as seen from a stirring/conveying chamber side.
Figure 6:
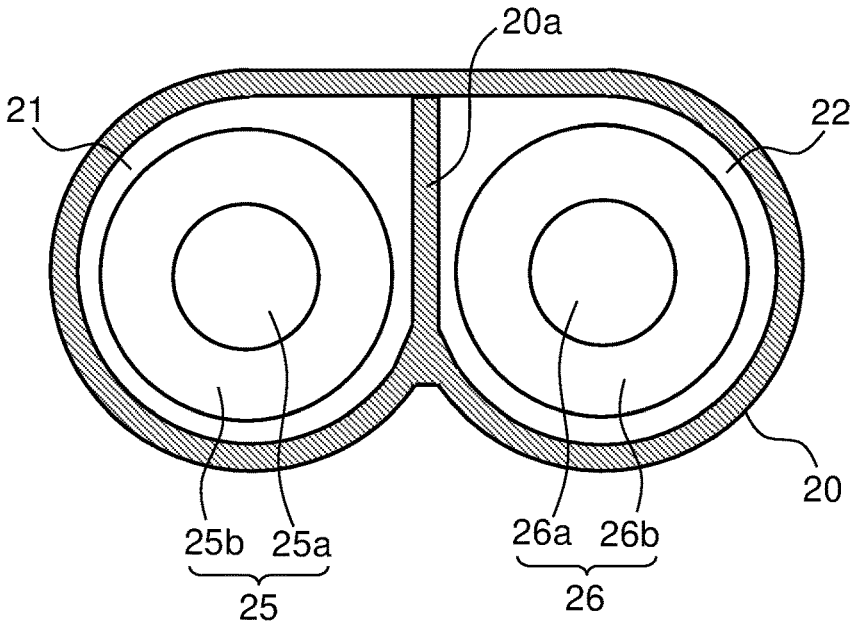
FIG. 6 is a cross-sectional view of the stirring/conveying chamber and a feeding/conveying chamber including a first partition wall in the developing device of the first embodiment.

FIG. 5 is a diagram of and around the downstream-side communication portion 20*f* in FIG. 4, as seen from the stirring/conveying chamber 21 side. FIG. 6 is a cross-sectional view (as seen from the direction of arrows BB' in FIG. 4) of the stirring/conveying chamber 21 and the feeding/conveying chamber 22 including the first partition wall 20*a* in the developing device 3*a* of the first embodiment. As shown in FIGS. 5 and 6, the first partition wall 20*a* extends up to the top faces of the stirring/conveying chamber 21 and the feeding/conveying chamber 22 so as to completely partition between the stirring/conveying chamber 21 and the feeding/conveying chamber 22 along the longitudinal direction (the left-right direction in FIG. 5, the direction perpendicular to the plane of FIG. 6).

Figure 7:
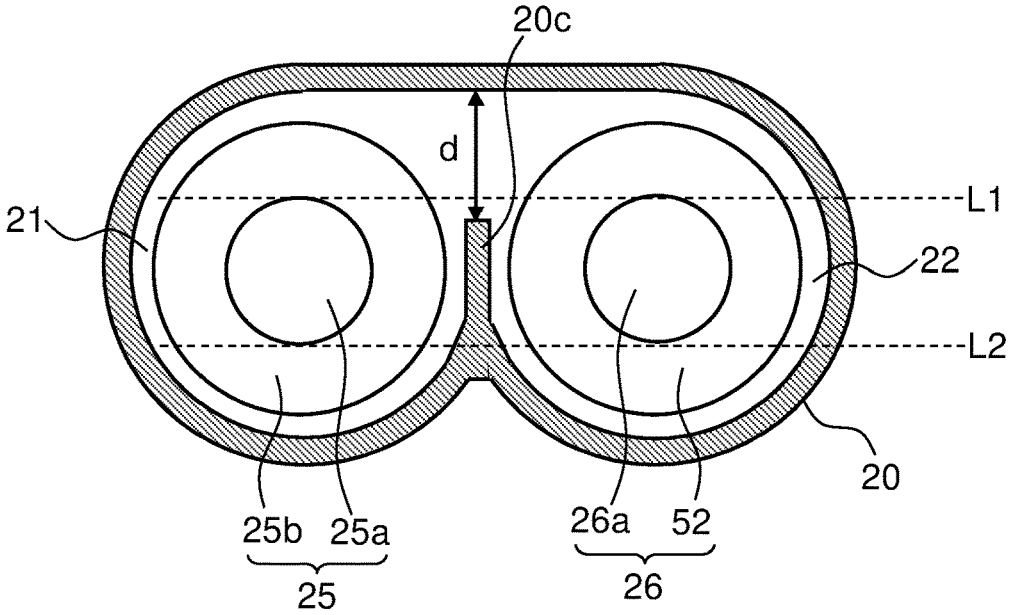
FIG. 7 is a cross-sectional view of the stirring/conveying chamber and the feeding/conveying chamber including a second partition wall in the developing device of the first embodiment.

FIG. 7 is a cross-sectional view (as seen from the direction of arrows CC' in FIG. 4) of the stirring/conveying chamber 21 and the feeding/conveying chamber 22 including the second partition wall 20*c* in the developing device 3*a* of the first embodiment. As shown in FIGS. 5 and 7, the second partition wall 20*c* is lower than the first partition wall 20*a*, and a gap (clearance) d is formed between a top end part of the second partition wall 20*c* and the inner surface of the developer container 20 (the stirring/conveying chamber 21 and the feeding/conveying chamber 22).

The developer passed from the feeding/conveying chamber 22 via the downstream-side communication portion 20*f* to the stirring/conveying chamber 21 mainly flows (as indicated by a hollow arrow in FIG. 4) in the main conveying direction (the direction of arrow P) by the action of the first conveying blade 25*b* of the stirring/conveying screw 25. However, since the conveying force of the stirring/conveying screw 25 hardly acts around the downstream-side communication portion 20*f*, part of the developer stagnates in an upstream-side end part (a left end part in FIG. 4) of the stirring/conveying chamber 21 with respect to the main conveying direction.

When the conveying speed of the developer is high, more developer is passed from the feeding/conveying chamber 22 to the stirring/conveying chamber 21, and less developer passes over the clearance between the feeding/conveying chamber 22 and the disk 55 to reach the regulating portion 52. Thus, the height of the second partition wall 20*c* is adjusted such that the developer stagnating around an upstream-side end part of the stirring/conveying chamber 21 moves over the second partition wall 20*c* to return to the feeding/conveying chamber 22 (regulating portion 52) only when the conveying speed is high. That is, the amount of developer that reaches the regulating portion 52 when the conveying speed is high is increased. This helps make the amount of developer that reaches the regulating portion 52 constant regardless of the conveying speed of the developer, and thus helps suppress variation in the amount of developer discharged and thereby stabilize the height of the developer in the developer container 20.

In adjusting the amount of developer that moves over the second partition wall 20*c* to return to the regulating portion 52, it is important how to adjust the height of the second partition wall 20*c*. When the second partition wall 20*c* is too high, the gap d is so small that the developer that is lifted by the stirring/conveying screw 25 hits the top face of the stirring/conveying chamber 21 and falls without moving over the second partition wall 20*c*. On the other hand, when the second partition wall 20*c* is too low, the stirring/conveying chamber 21 and the feeding/conveying chamber 22 are no longer partitioned from each other, and this may cause more developer to stagnate around the downstream-side communication portion 20*f*. Although it is preferable that the gap d be minimized to make the developing device 3*a* compact, the gap d needs to be set such that, even when the conveying speed is high, the developer does not hit the top face of the stirring/conveying chamber 21.

In this embodiment, as shown in FIG. 7, an upper end part of the second partition wall 20*c* is located between an upper end part L1 and a lower end part L2 of the rotary shaft 26*a* of the feeding/conveying screw 26 so that the dimension of the gap d falls in a predetermined range.

In this embodiment, the rotary shaft 25*a* of the stirring/conveying screw 25 and the rotary shaft 26*a* of the feeding/conveying screw 26 have the same outer diameter and are arranged at the same position in the height direction. As a result, upper end parts, and also lower end parts, of the rotary shafts 25*a* and 26*a* are located at the same height. This however is not meant as any limitation: the rotary shafts 25*a* and 26*a* may have different outer diameters or may be arranged at different positions in the height direction.

Figure 8:
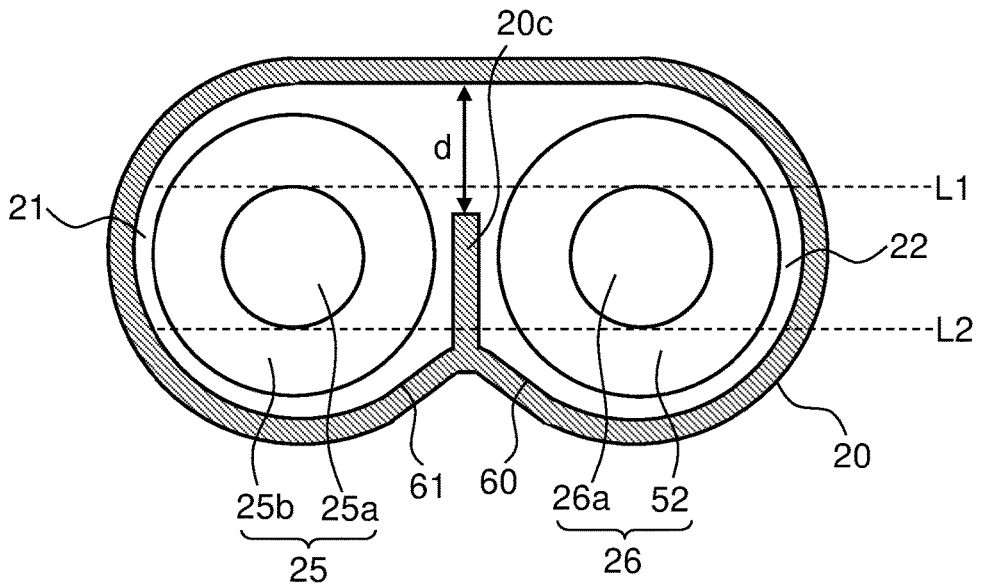
FIG. 8 is a cross-sectional view of a stirring/conveying chamber and a feeding/conveying chamber including a second partition wall in a developing device according to a second embodiment.
Figure 9:
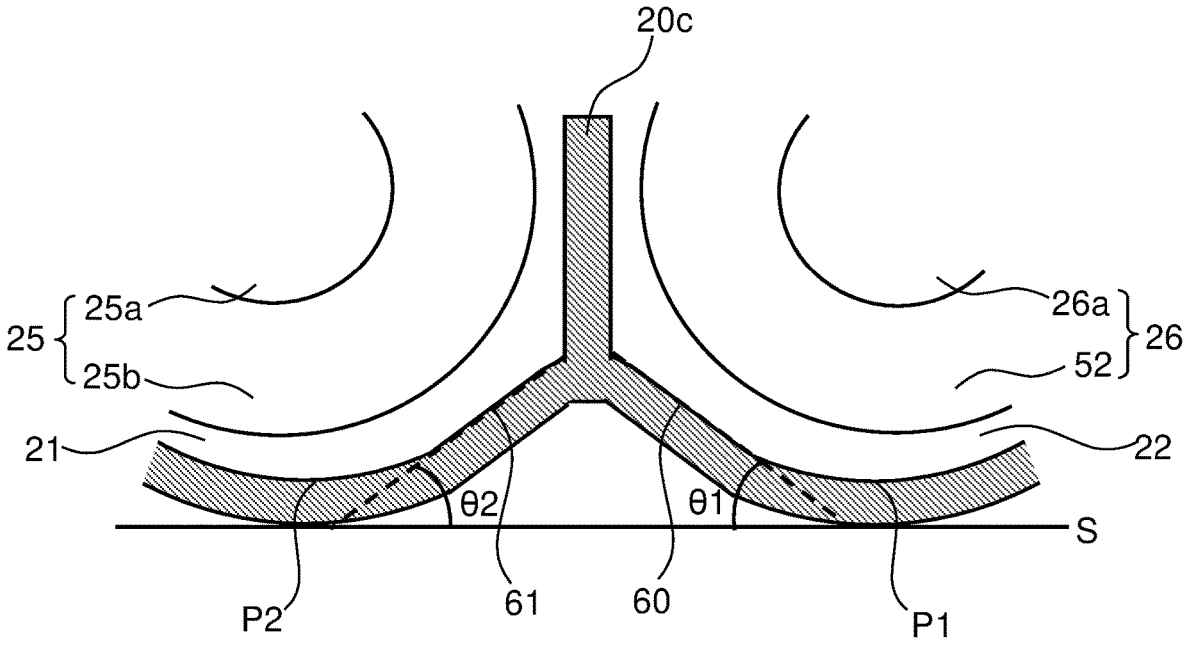
FIG. 9 is an enlarged part view of and around a base end part of the second partition wall.

FIG. 8 is a cross-sectional view of a stirring/conveying chamber 21 and a feeding/conveying chamber 22 including a second partition wall 20*c* in a developing device 3*a* according to a second embodiment of the present disclosure. FIG. 9 is an enlarged part view of and around a base end part of the second partition wall 20*c* in FIG. 8. In this embodiment, the angle of an inclined surface 60 that extends from the bottom surface of the feeding/conveying chamber 22 toward the second partition wall 20*c* is defined. In other respects including the height of the second partition wall 20*c*, the developing device 3*a* is structured similarly as in the first embodiment.

Specifically, as shown in FIG. 9, with respect to the inclined surface 60 with a rising slope from the lowest point P1 on the inner surface of the feeding/conveying chamber 22 toward the second partition wall 20*c*, its maximum inclination angle θ1 with respect to the horizontal plane S is defined to fall in a predetermined range. In this way it is possible to adjust the flow of developer that passes from the feeding/conveying chamber 22 over the second partition wall 20*c* to the stirring/conveying chamber 21 and thereby stabilize, against a change in the flowability of developer, how developer stagnates around the downstream-side communication portion 20*f*.

The maximum inclination angle θ1 can be adjusted according to the flowability (bulk density) of the developer used. A small maximum inclination angle θ1 tends to reduce, when the stirring speed of the stirring/conveying screw 25 and the feeding/conveying screw 26 is high, the movement speed of the developer that is passed from the regulating portion 52 over the second partition wall 20*c* to the stirring/conveying chamber 21, resulting in a reduced amount of developer in the developer container 20. A large maximum inclination angle θ1 tends to increase, when the stirring speed of the stirring/conveying screw 25 and the feeding/conveying screw 26 is low, the movement speed of the developer that is passed from the regulating portion 52 over the second partition wall 20*c* to the stirring/conveying chamber 21, resulting in an increased amount of developer in the developer container 20. As will become clear from the practical examples described later, the maximum inclination angle θ1 is preferably 30° or more but 60° or less, and more preferably 45°.

In this embodiment, the maximum inclination angle θ1 of the inclined surface 60 is equal to the maximum inclination angle θ2 of an inclined surface 61 with a rising slope from the lowest point P2 on the inner surface of the stirring/conveying chamber 21 toward the second partition wall 20*c*. This however is not meant as any limitation: the maximum inclination angle θ1 of the inclined surface 60 and the maximum inclination angle θ2 of the inclined surface 61 may be different.

The embodiments described above are in no way meant to limit the present disclosure, which thus allows for many modifications and variations within the spirit of the present disclosure. Although the above embodiments deal with developing devices 3*a* to 3*d* provided with a developing roller 31 as shown in FIG. 2, this is not meant to be any limitation. The present disclosure is applicable to various developing devices which use two-component developer containing toner and carrier, such as those which, for example, have a magnetic roller for carrying developer and form a toner layer by moving toner alone from the magnetic roller to a developing roller 31 to develop an electrostatic latent image using the toner layer on the developing roller 31.

Although, in the above embodiments, in order to retain developer on the upstream side of the developer discharge portion 20*h*, the regulating portion 52 composed of a helical blade wound in the direction opposite to the second conveying blade 26*b* and the disk 55 are provided on the feeding/conveying screw 26, this is not meant to limit the structure of the regulating portion 52. For example, the disk 55 may be omitted and only the regulating portion 52 may be provided, or the regulating portion 52 and a plurality of disks 55 may be combined, or the regulating portion 52 may be composed only of a plurality of disks.

The present disclosure is applicable not only to tandem-type color printers like the one shown in FIG. 1 but to various types of image forming apparatuses employing a two-component development system, such as digital and analogue monochrome copiers, monochrome printers, color copiers, and facsimile machines. The benefits of the present disclosure will now be described in more detail by way of practical examples.

EXAMPLES I

In an image forming apparatus 100 like the one shown in FIG. 1, how the amount of developer in the developing devices 3*a* to 3*d* changed as the conveying speed of developer was changed was studied. The tests were conducted on the image forming portion Pa of cyan including the photosensitive drum 1*a* and the developing device 3*a*.

The tests proceeded as follows. A developing device 3*a* according to the first embodiment where, as shown in FIGS. 4 to 7, the second partition wall 20*c* was made lower than the first partition wall 20*a* so that a gap d was provided between the second partition wall 20*c* and the inner surface of the developer container 20 and an upper end part of the second partition wall 20*c* was arranged between upper end parts L1 and lower parts L2 of the rotary shafts 25*a* and 26*a* was taken as Practical Example 1. A developing device 3*a* where the first and second partition walls 20*a* and 20*c* had the same height was taken as Comparative Example 1.

The developer containers 20 of the developing devices 3*a* of the Practical Example 1 and Comparative Example 1 were each loaded with 175 cc of developer (with a toner concentration of 6%), and the developing devices 3*a* were each driven in a normal-temperature normal-humidity environment (25° C., 50%) with the stirring/conveying screw 25 and the feeding/conveying screw 26 rotated at three different rotation speeds of 139 rpm, 278 rpm, and 449 rpm to stir and convey the developer. When the developer ceased to be discharged from the discharge portion 20*h*, the amount (stable weight, stable volume) of developer in the developer container 20 was measured.

The first conveying blade 25*b* of the stirring/conveying screw 25 and the second conveying blade 26*b* of the feeding/conveying screw 26 that were used in Practical Example 1 and Comparative Example 1 were helical blades with an outer diameter of 18 mm. The regulating portion 52 was formed of two helical blades wound in opposite directions and having an outer diameter of 18 mm, and the discharging blade 53 was a helical blade with an outer diameter of 8 mm. The gap from the first conveying blade 25*b*, the regulating portion 52, and the discharging blade 53 to the inner surface of the developer discharge portion 20 was 1.5 mm. The height of the first partition wall 20*a* was 15 mm.

In the developing device 3*a* of Practical Example 1, the height of the second partition wall 20*c* was 8 mm, and the gap d from the upper end part of the second partition wall

20*c* to the inner surface of the developer container 20 was 7 mm. In the developing device 3*a* of Comparative Example 1, the height of the second partition wall 20*c* was, as with the first partition wall 20*a*, 15 mm.

The amount of developer was measured as follows. The developing devices 3*a* of Practical Example 1 and Comparative Example 1 were each mounted in a testing machine and the developer was stirred as the rotation speed of the stirring/conveying screw 25 and the feeding/conveying screw 26 (i.e., the conveying speed of the developer in the stirring/conveying chamber 21 and the feeding/conveying chamber 22) was changed, and then the developing device 3*a* was removed and its weight was measured. The amount (stable weight) of developer was calculated by subtracting from the measured weight of the developing device 3*a* the weight of the empty developing device 3*a* with the developer removed. The stable volume was calculated by dividing the calculated amount of developer by the bulk density. Table 1 shows the relationship of the rotation speed of the stirring/conveying screw 25 and the feeding/conveying screw 26 with the stable volume.

TABLE 1

| | Developer Stable Volume [cc] | |
|---|---|---|
| Rotation Speed [rpm] | Practical Example 1 | Comparative Example 1 |
| 139 | 155 | 159 |
| 278 | 154 | 166 |
| 449 | 152 | 171 |

As will be clear from Table 1, in Practical Example 1 where the height of the first partition wall 20*a* was 15 mm and the height of the second partition wall 20*c* was 8 mm, even when the rotation speed of the stirring/conveying screw 25 and the feeding/conveying screw 26 was changed, the variation in the stable volume was small.

By contrast, in Comparative Example 1 where the height of both the first and second partition walls 20*a* and 20*c* was 15 mm, the higher the rotation speed of the stirring/conveying screw 25 and the feeding/conveying screw 26, the larger the stable volume. These results confirm that, with the developing device 3*a* of the Practical Example 1, even when the conveying speed of the developer changes, it is possible to keep the stable volume of the developer constant, and thus to effectively suppress development failure and the like due to an insufficient or excessive height of developer.

EXAMPLES II

How the amount of developer in the developing devices 3*a* to 3*d* changed as the flowability of the developer changed was studied. The tests were conducted, as with Examples I, on the image forming portion Pa of cyan including the photosensitive drum 1*a* and the developing device 3*a*.

The tests proceeded as follows. Developing devices 3*a* according to the second embodiment where, as shown in FIGS. 8 and 9, the second partition wall 20*c* was made lower than the first partition wall 20*a* so that a gap d was provided between the second partition wall 20*c* and the inner surface of the developer container 20, an upper end part of the second partition wall 20*c* was arranged between upper end parts L1 and lower parts L2 of the rotary shafts 25*a* and 26*a*, and the maximum inclination angle θ1 of the inclined surface 60 was 30° and 45° respectively were taken as Practical Examples 2 and 3. A developing device 3*a* where the first and second partition walls 20*a* and 20*c* had the same height and the maximum inclination angle θ1 of the inclined surface 60 was 30° was taken as Comparative Example 2.

As to the flowability of developer, it is generally known that higher bulk density goes with higher flowability and that lower bulk density goes with lower flowability. Accordingly, bulk density was used as the criterion for the flowability of developer.

The developer containers 20 of the developing devices 3*a* of Practical Examples 2 and 3 and Comparative Example 2 were each loaded with 175 cc of one, at a time, of three types of developer with bulk densities of 1.78, 1.88, and 1.97 respectively, and the developing devices 3*a* were each driven in a normal-temperature normal-humidity environment (25° C., 50%) with the stirring/conveying screw 25 and the feeding/conveying screw 26 rotated at three different rotation speeds of 139 rpm, 278 rpm, and 449 rpm to stir and convey the developer. When the developer ceased to be discharged from the discharge portion 20*h*, the amount (stable weight, stable volume) of developer in the developer container 20 was measured.

In the developing devices 3*a* of Practical Examples 2 and 3, the height of the second partition wall 20*c* was 8 mm, and the gap d between the upper end part of the second partition wall 20*c* and the inner surface of the 20 was 7 mm. In the developing device 3*a* of Comparative Example 2, the height of the second partition wall 20*c* was, as with the first partition wall 20*a*, 15 mm. The stirring/conveying screw 25 and the feeding/conveying screw 26 were structured, and the amount of developer was measured, similarly as with Examples I. The results are shown in Table 2.

TABLE 2

| | Rotation | Developer Stable Volume [cc] | | |
|---|---|---|---|---|
| Bulk Density | Speed [rpm] | Practical Example 2 | Practical Example 3 | Comparative Example 2 |
| 1.78 | 139 | 159 | 158 | 166 |
| | 278 | 155 | 156 | 172 |
| | 449 | 154 | 155 | 177 |
| 1.88 | 139 | 155 | 155 | 159 |
| | 278 | 154 | 154 | 166 |
| | 449 | 152 | 152 | 171 |
| 1.97 | 139 | 153 | 154 | 150 |
| | 278 | 151 | 151 | 156 |
| | 449 | 149 | 150 | 167 |

As will be clear from Table 2, in Practical Examples 2 and 3 where the height of the first partition wall 20*a* was 15 mm, the height of the second partition wall 20*c* was 8 mm, and the maximum inclination angle θ1 was 30° and 45° respectively, irrespective of the bulk density of the developer, the difference in stable volume observed as the rotation speed of the stirring/conveying screw 25 and the feeding/conveying screw 26 was changed was 5 cc or less, exhibiting a small variation.

In particular, in Practical Example 3 where the maximum inclination angle θ1 was 45°, the difference in stable volume observed when the bulk density was 1.78, corresponding to the lowest flowability of developer, was 3 cc, indicating further enhanced stability against changes in developer flowability and stirring speed.

By contrast, in Comparative Example 2 where the height of both the first and second partition walls 20*a* and 20*c* was 15 mm and the maximum inclination angle θ1 was 30°, the difference in stable volume observed as the rotation speed of the feeding/conveying screw 26 was changed was 10 cc or more, exhibiting a large variation.

EXAMPLES III

How the amount of developer in the developing devices 3*a* to 3*d* changed as the maximum inclination angle θ1 of the inclined surface 60 of the developer container 20 was changed was studied. The tests were conducted, as with Examples I and II, on the image forming portion Pa of cyan including the photosensitive drum 1*a* and the developing device 3*a*.

The tests proceeded as follows. The developing devices 3*a* used in Examples II in which the maximum inclination angle θ1 of the inclined surface 60 was 30° and 45° respectively were taken as Practical Examples 2 and 3, and a developing device 3*a* identical with the developing devices 3*a* of Practical Examples 2 and 3 except that the maximum inclination angle θ1 was 60° was taken as Practical Example 4. Developing devices 3*a* identical with the developing devices 3*a* of Practical Examples 2 and 3 except that the maximum inclination angle θ1 was 15° and 75° respectively were taken as Comparative Examples 3 and 4.

The developer containers 20 of the developing devices 3*a* of Practical Examples 2 to 4 and Comparative Examples 3 and 4 were each loaded with 175 cc of developer with a bulk density of 1.88, and the developing devices 3*a* were each driven in a normal-temperature normal-humidity environment (25° C., 50%) with the stirring/conveying screw 25 and the feeding/conveying screw 26 rotated at three different rotation speeds of 139 rpm, 278 rpm, and 449 rpm to stir and convey the developer. When the developer ceased to be discharged from the discharge portion 20*h*, the amount (stable weight, stable volume) of developer in the developer container 20 was measured. The amount of developer was measured similarly as with Examples I. The results are shown in Table 3.

TABLE 3

| | Developer Stable Volume [cc] | | | | |
|---|---|---|---|---|---|
| Rotation Speed [rpm] | Practical Example 2 | Practical Example 3 | Practical Example 4 | Comparative Example 3 | Comparative Example 4 |
| 139 | 155 | 155 | 157 | 151 | 163 |
| 278 | 154 | 154 | 155 | 150 | 158 |
| 449 | 152 | 152 | 154 | 146 | 154 |
| Volume Difference [cc] | 3 | 3 | 3 | 5 | 9 |

As will be clear from Table 3, in all of Practical Examples 2 to 4 where the maximum inclination angle θ1 was 30°, 45°, and 60° respectively, the difference in stable volume observed as the rotation speed of the stirring/conveying screw 25 and the feeding/conveying screw 26 was changed were 3 cc, exhibiting a small variation.

By contrast, in Comparative Example 3 where the maximum inclination angle θ1 was 15°, the difference in stable volume observed as the rotation speed of the feeding/conveying screw 26 was changed was 5 cc, and in Comparative Example 4 where the maximum inclination angle θ1 was 75°, the difference in stable volume observed as the rotation speed of the feeding/conveying screw 26 was changed was 9 cc, exhibiting large variations.

The present disclosure is applicable to a developing device which supplies two-component developer containing toner and carrier and which discharges excessive developer, as well as to an image forming apparatus provided with such a developing device. Based on the present disclosure, it is possible to provide a developing device which can reduce variations in the height and weight of developer in a developer container against changes in the flowability and conveyance speed of developer change.

What is claimed is:

1. A developing device, comprising:

a developer container including first and second conveying chambers which are arranged side by side, a first partition wall which partitions between the first and second conveying chambers along a longitudinal direction, communication portions through which the first and second conveying chambers communicate with each other in opposite end parts of the first partition wall, a developer supply port through which developer containing magnetic carrier and toner is supplied, and a developer discharge portion which is provided in a downstream-side end part of the second conveying chamber and through which excessive developer is discharged;

a developer carrying member which is rotatably supported on the developer container and which carries, on a surface thereof, the developer in the second conveying chamber;

a first stirring/conveying member which includes a rotary shaft and a first conveying blade formed on an outer circumferential face of the rotary shaft and which stirs and conveys the developer in the first conveying chamber in a first direction; and a second stirring/conveying member which includes a rotary shaft and a second conveying blade formed on an outer circumferential face of the rotary shaft and which stirs and conveys the developer in the second conveying chamber in a second direction opposite to the first direction, wherein the second stirring/conveying member includes a regulating portion which is formed adjacent to the second conveying blade on a downstream side thereof in the second direction and which is composed of a conveying blade for conveying the developer in a direction opposite to the second conveying blade, and a discharging blade which is formed adjacent to the regulating portion on a downstream side thereof in the second direction and which conveys the developer in a same direction as the second conveying blade to discharge the developer through the developer discharge portion, the communication portions are composed of a first communication portion through which, at a downstream side in the first direction, the developer is passed from the first conveying chamber to the second conveying chamber, and a second communication portion through which, at a downstream side in the second direction, the developer is passed from the second conveying chamber to the first conveying chamber, the developer container includes a second partition wall which is arranged adjacent to the conveying blade in a radial direction thereof, the conveying blade constituting the regulating portion, on a downstream side of the second communication portion in the second direction to partition between the first conveying chamber and the regulating portion, the second partition wall is arranged on an extension line from the first partition wall so that the second partition wall and the first partition wall together form the second communication portion, and the second partition wall has a smaller height than the first partition wall, and an upper end part of the second partition wall is located between an upper end part and a lower end part of the rotary shaft of the second stirring/conveying member.

2. The developing device according to claim 1, wherein a maximum inclination angle, with respect to a horizontal plane, of an inclined surface extending from a lowest point on an inner surface of the second conveying chamber toward the second partition wall is 30° or more but 60° or less.

3. The developing device according to claim 2, wherein a maximum inclination angle, with respect to a horizontal plane, of an inclined surface extending from a lowest point on an inner surface of the second conveying chamber toward the second partition wall is 45°.

4. The developing device according to claim 2, wherein the maximum inclination angle of the inclined surface extending from the lowest point on the inner surface of the second conveying chamber toward the second partition wall is equal to a maximum inclination angle of an inclined surface extending from a lowest point on an inner surface of the first conveying chamber toward the second partition wall.

5. The developing device according to claim 1, wherein a rotation speed of the first and second stirring/conveying members is switchable among a plurality of speeds.

6. An image forming apparatus comprising an image forming portion, the image forming portion forming an image on a recording medium, the image forming portion including an image carrying member on which an electrostatic latent image is formed, and a developing device according to claim 1 which develops the electrostatic latent image formed on the image carrying member into a toner image.

* * * * *